US012734456B2

(12) United States Patent
Chen et al.

(10) Patent No.: US 12,734,456 B2
(45) Date of Patent: Sep. 15, 2026

(54) BIONIC ANIMAL

(71) Applicant: Pioneer Material Precision Tech Co., Ltd., New Taipei City (TW)

(72) Inventors: Chih-Sheng Chen, New Taipei City (TW); Ching-Hung Liu, New Taipei City (TW)

(73) Assignee: Pioneer Material Precision Tech Co., Ltd., New Taipei City (TW)

( * ) Notice: Subject to any disclaimer, the term of this patent is extended or adjusted under 35 U.S.C. 154(b) by 234 days.

(21) Appl. No.: 18/822,461

(22) Filed: Sep. 2, 2024

(65) Prior Publication Data

US 2026/0042029 A1 Feb. 12, 2026

(30) Foreign Application Priority Data

Aug. 12, 2024 (CN) ..... 202421938929.4

(51) Int. Cl.
*A63H 11/00* (2006.01)

(52) U.S. Cl.
CPC ..... *A63H 11/00* (2013.01); *A63H 2011/16* (2013.01)

(58) Field of Classification Search
CPC ..... A63H 11/00; A63H 11/18; A63H 11/20; A63H 2011/16
See application file for complete search history.

(56) References Cited

U.S. PATENT DOCUMENTS 6,790,119 B1 * 9/2004 Chia ..... A63H 23/14 446/353
10,836,032 B2 * 11/2020 Xiong ..... B25J 9/0009
11,833,688 B2 * 12/2023 Li ..... B25J 9/1653
11,969,662 B2 * 4/2024 Ishibashi ..... A63H 11/20
12,515,140 B2 * 1/2026 Huang ..... A01M 31/06
2011/0165821 A1 7/2011 Randall
2019/0091592 A1 * 3/2019 Gillies ..... B62D 57/032
2019/0262735 A1 * 8/2019 Katayama ..... A63H 29/22
(Continued)

FOREIGN PATENT DOCUMENTS

CN 201143991 Y 11/2008
CN 100584695 C 1/2010
(Continued)

OTHER PUBLICATIONS

G. Chen et al., 'Bionic design of multi-toe quadruped robot for planetary surface exploration', Machines 2022, 10 827, https://doi.org/10.3390/machines10100827, MDPI, Sep. 20, 2022, Sep. 20, 2022.

*Primary Examiner* — Kurt Fernstrom
(74) *Attorney, Agent, or Firm* — Winston Hsu

(57) ABSTRACT

A bionic animal includes a shell, a first front foot driving motor, a first front foot rotating shaft, a transmission mechanism, a frame, a second front foot driving motor, a second front foot rotating shaft and a front foot assembly. The shell has a first shaft hole. The first front foot rotating shaft is disposed in the first shaft hole. The transmission mechanism is connected to the first front foot driving motor and the first front foot rotating shaft. The frame is connected to the first front foot rotating shaft. The second front foot driving motor is disposed in the frame. The second front foot rotating shaft is connected to the second front foot driving motor. The front foot assembly is connected to the second front foot rotating shaft.

18 Claims, 14 Drawing Sheets

(56) References Cited

U.S. PATENT DOCUMENTS

| | | | | |
|---|---|---|---|---|
| 2021/0001476 | A1* | 1/2021 | Woo | B25J 11/00 |
| 2024/0408505 | A1* | 12/2024 | Chen | A63H 23/04 |
| 2025/0319413 | A1* | 10/2025 | Tearne | A63H 11/04 |

FOREIGN PATENT DOCUMENTS

| | | | |
|---|---|---|---|
| CN | 103863539 | A | 6/2014 |
| CN | 115071933 | A | 9/2022 |
| TW | M653767 | U | 4/2024 |
| TW | M655067 | U | 5/2024 |
| WO | 2022/100557 | A1 | 5/2022 |

* cited by examiner

BIONIC ANIMAL

BACKGROUND OF THE INVENTION

1. Field of the Invention

The invention relates to a bionic animal and, more particularly, to an amphibious bionic animal.

2. Description of the Prior Art

With the advancement of technology, the types of existing bionic animals are becoming more and more diverse. However, when a bionic animal (e.g. bionic turtle) want to be able to swim underwater and crawl on land at the same time, the internal mechanism is usually quite complicated, and the manufacturing cost is therefore very expensive. Furthermore, waterproof structures also require special design. In order to meet waterproof requirements, some designs will use a waterproof motor. However, the cost of a waterproof motor is usually much higher than that of a non-waterproof motor.

SUMMARY OF THE INVENTION

The invention provides an amphibious bionic animal, so as to solve the aforesaid problems.

According to an embodiment of the invention, a bionic animal comprises a shell, a first front foot driving motor, a first front foot rotating shaft, a transmission mechanism, a frame, a second front foot driving motor, a second front foot rotating shaft and a front foot assembly. The shell has a first shaft hole. The first front foot driving motor is disposed in the shell. The first front foot rotating shaft is disposed in the first shaft hole. The transmission mechanism is disposed in the shell and connected to the first front foot driving motor and the first front foot rotating shaft. The frame is connected to the first front foot rotating shaft. The second front foot driving motor is disposed in the frame. The second front foot rotating shaft is disposed in the frame and connected to the second front foot driving motor. The front foot assembly is connected to the second front foot rotating shaft. The first front foot driving motor drives the frame to rotate around a first axis through the transmission mechanism and the first front foot rotating shaft to drive the front foot assembly to rotate around the first axis. The second front foot driving motor drives the front foot assembly to rotate around a second axis through the second front foot rotating shaft. The first axis is perpendicular to the second axis.

In an embodiment, the shell comprises an upper shell, a middle shell, a lower shell, a first sealing ring and a second sealing ring, the first sealing ring is sandwiched between the upper shell and the middle shell, and the second sealing ring is sandwiched between the middle shell and the lower shell.

In an embodiment, the first sealing ring has an outer flange, an inner flange and a first recess, the first recess is located between the outer flange and the inner flange, the upper shell has a boss, the middle shell has a second recess, the first sealing ring is embedded in the second recess, the boss is embedded in the first recess, and the outer flange and the inner flange are sandwiched between the upper shell and the middle shell.

In an embodiment, the transmission mechanism comprises a first crank, a swing arm and a first linkage rod, the first crank is connected to the first front foot driving motor, the swing arm is connected to the first front foot rotating shaft, and the first linkage rod is connected to the first crank and the swing arm.

In an embodiment, the swing arm is formed with a wiring hole.

In an embodiment, the frame comprises a metal front frame, a plastic rear frame and a third sealing ring, the plastic rear frame is connected to the first front foot rotating shaft, and the third sealing ring is sandwiched between the metal front frame and the plastic rear frame.

In an embodiment, the first front foot rotating shaft further comprises a first anti-rust bearing, a fourth sealing ring and a fifth sealing ring, the fourth sealing ring is sandwiched between the shell and the first anti-rust bearing, and the fifth sealing ring is sandwiched between the first front foot rotating shaft and the frame.

In an embodiment, the second front foot rotating shaft comprises a first adapter ring, a second adapter ring, a second anti-rust bearing and a transmission shaft, the first adapter ring is connected to the second front foot driving motor, the second adapter ring is connected to the first adapter ring, the transmission shaft is connected to the second adapter ring and the front foot assembly, and the second anti-rust bearing is sleeved on the transmission shaft.

In an embodiment, the front foot assembly comprises a front foot bracket and a soft front foot member, the front foot bracket is connected to the second front foot rotating shaft, and the soft front foot member is fixed to the front foot bracket.

In an embodiment, the shell further has a second shaft hole. The bionic animal further comprises a rear foot driving motor, a rear foot rotating shaft and a rear foot assembly. The rear foot driving motor is disposed in the shell. The rear foot rotating shaft is disposed in the second shaft hole and connected to the rear foot driving motor. The rear foot assembly is connected to the rear foot rotating shaft. The rear foot driving motor drives the rear foot assembly to rotate around the first axis through the rear foot rotating shaft.

In an embodiment, the rear foot assembly comprises a rear foot bracket and a soft rear foot member, the rear foot bracket is connected to the rear foot rotating shaft, and the soft rear foot member is fixed to the rear foot bracket.

In an embodiment, the shell further has a third shaft hole, a guiding member and a restraining member. The bionic animal further comprises a head driving motor, a head rotating shaft, a second crank, a second linkage rod, a sliding rod and a head. The head driving motor is disposed in the shell. The head rotating shaft is disposed in the third shaft hole and connected to the head driving motor. The second crank is connected to the head rotating shaft. The second linkage rod is connected to the second crank. The sliding rod is connected to the second linkage rod and passes through the guiding member and the restraining member. The guiding member and the restraining member restrain a moving direction of the sliding rod. The head is connected to the sliding rod. The head driving motor drives the second crank to rotate around the first axis through the head rotating shaft, and the second crank drives the head to move along the second axis through the second linkage rod and the sliding rod.

In an embodiment, the bionic animal further comprises a head, a first infrared sensor, a second infrared sensor and a third infrared sensor. The head extends from a front side of the shell, the first infrared sensor, the second infrared sensor and the third infrared sensor are disposed in the shell and located behind the head, and the first infrared sensor is located between the second infrared sensor and the third infrared sensor.

In an embodiment, an angle between an orientation of the first infrared sensor and an orientation of the second infrared sensor is larger than 0 degrees and smaller than or equal to 90 degrees, and an angle between the orientation of the first infrared sensor and an orientation of the third infrared sensor is larger than 0 degrees and smaller than or equal to 90 degrees.

In an embodiment, the bionic animal further comprises two electrodes exposed from the shell. The two electrodes are configured to sense a voltage difference to determine whether the bionic animal is in water or on land.

In an embodiment, the bionic animal further comprises at least one circuit board and a partition. The at least one circuit board and the partition are disposed in the shell, the first front foot driving motor and the transmission mechanism are located at a side of the partition, and the at least one circuit board is located at another side of the partition.

In an embodiment, the bionic animal further comprises a rear foot driving motor, a head driving motor and a battery module. The rear foot driving motor, the head driving motor and the battery module are disposed in the shell, and the first front foot driving motor, the rear foot driving motor and the head driving motor are located around the battery module.

In an embodiment, the bionic animal further comprises a head and a rear foot driving motor. The head extends from a front side of the shell, the rear foot driving motor is disposed in the shell, and the first front foot driving motor is closer to the head than the rear foot driving motor.

As mentioned in the above, the first front foot driving motor may drive the front foot assembly to rotate around the first axis through the transmission mechanism and the first front foot rotating shaft, and the second front foot driving motor may drive the front foot assembly to rotate around the second axis through the second front foot rotating shaft. Accordingly, the front foot assembly of the bionic animal may swing up, down, forward and backward, thereby giving the bionic animal a variety of movements, such that the bionic animal is able to swim underwater or crawl on land. Furthermore, the rear foot driving motor may drive the rear foot assembly to rotate around the first axis through the rear foot rotating shaft, such that the rear foot assembly is able to swing freely. Moreover, the head driving motor may drive the head to move along the second axis through the head rotating shaft, the second crank, the second linkage rod and the sliding rod. The center of gravity of the bionic animal may be shifted through the swing of the front foot assembly and/or the movement of the head to achieve control of floating and diving. The invention may achieve waterproof requirements through the arrangement of multiple sealing rings. In an embodiment, three infrared sensors located behind the head may be configured to detect obstacles in front, left and right of the bionic animal. In an embodiment, the invention may utilize the two electrodes exposed from the shell to sense the voltage difference to determine whether the bionic animal is in water or on land.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
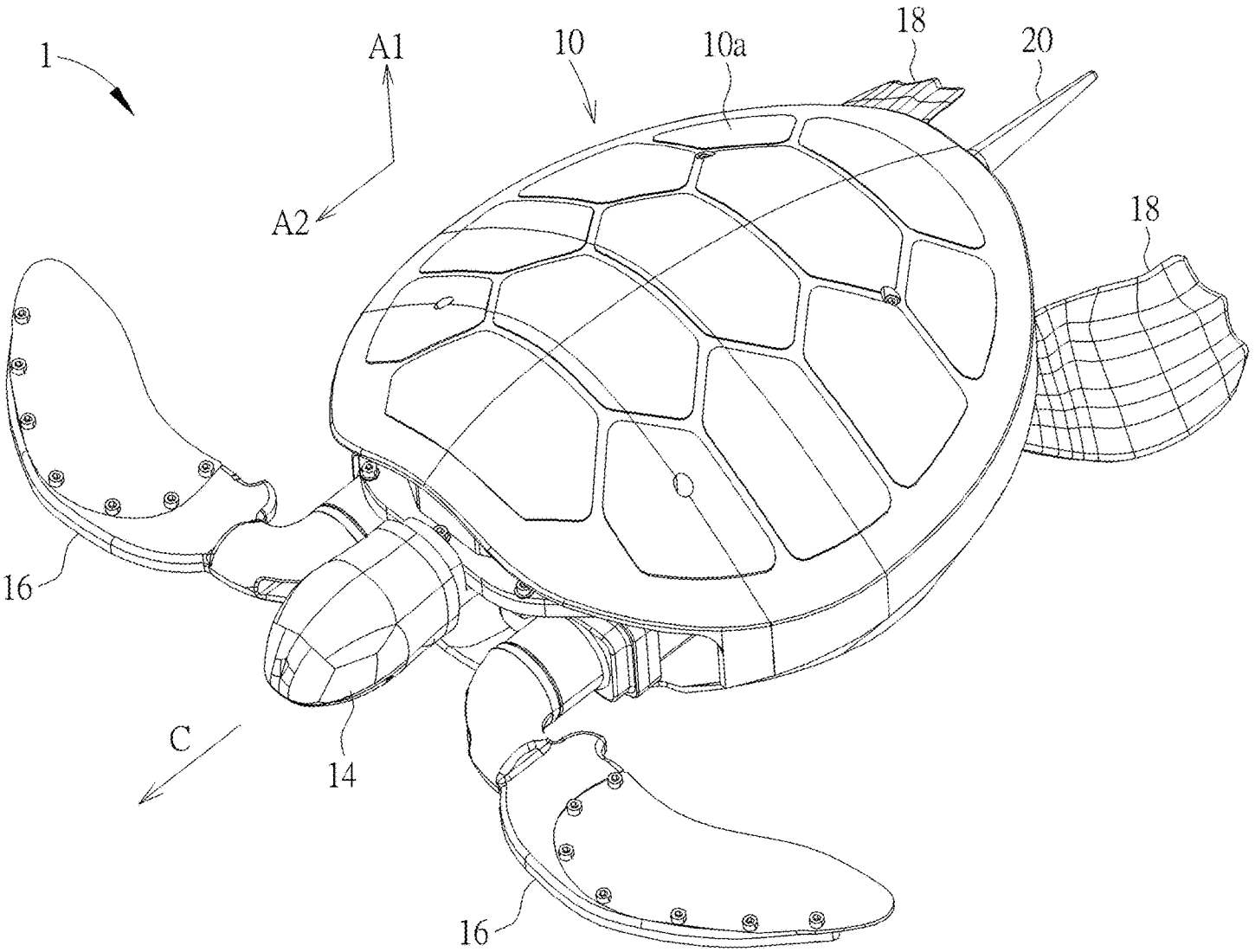
FIG. 1 is a perspective view illustrating a bionic animal according to an embodiment of the invention.
Figure 2:
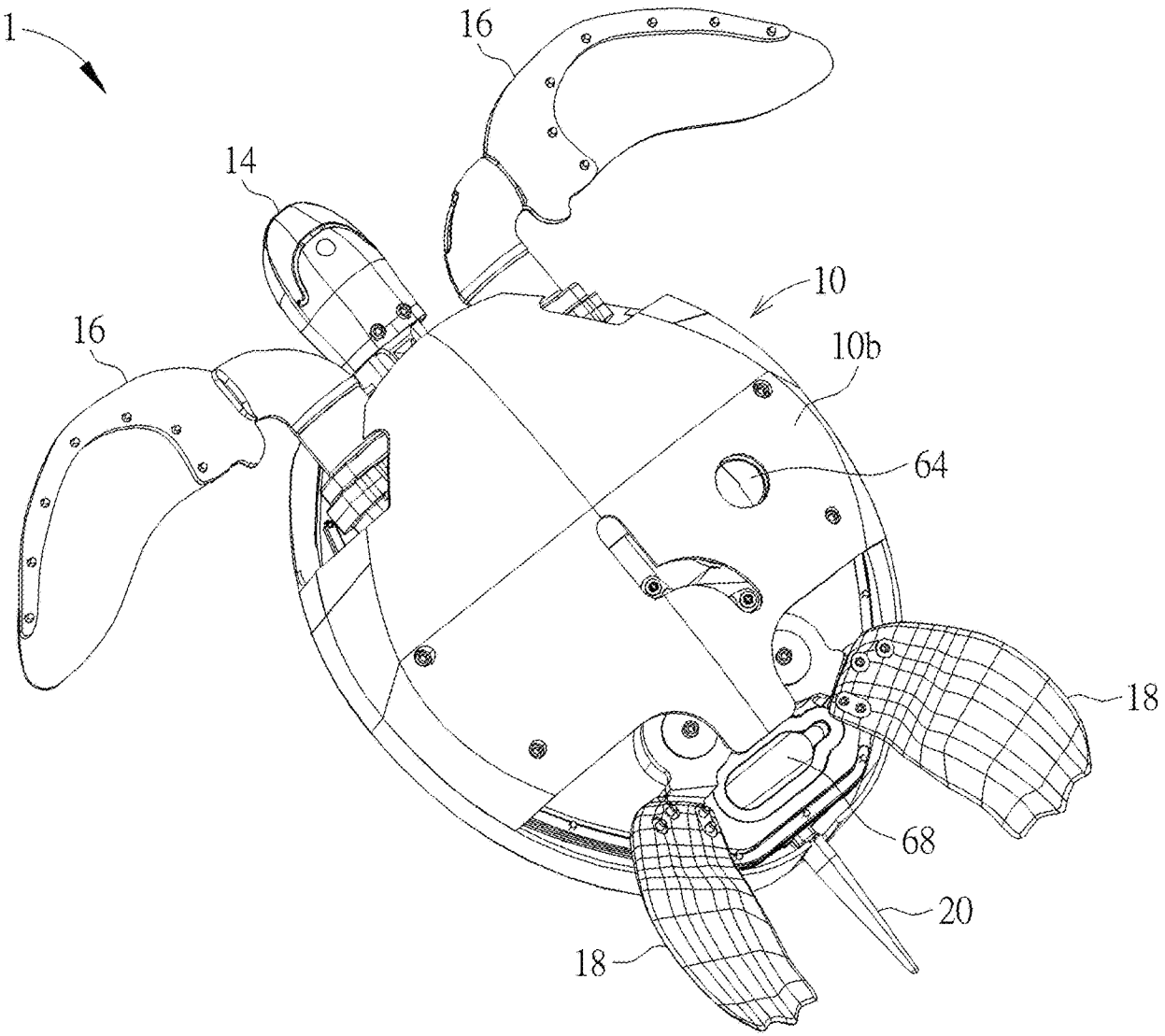
FIG. 2 is a perspective view illustrating the bionic animal shown in FIG. 1 from another viewing angle.
Figure 3:
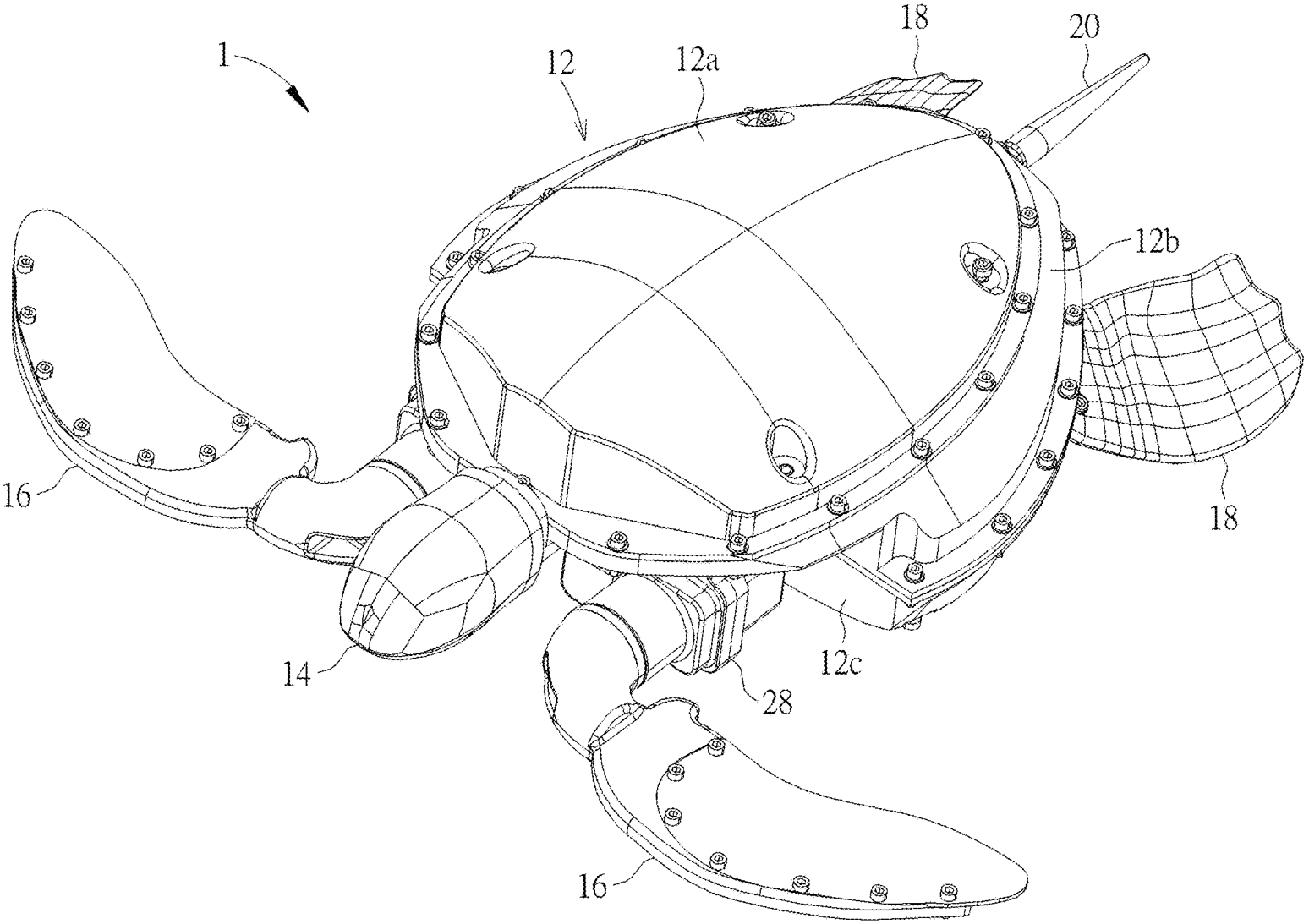
FIG. 3 is a perspective view illustrating the bionic animal shown in FIG. 1 without an outer cover.
Figure 4:
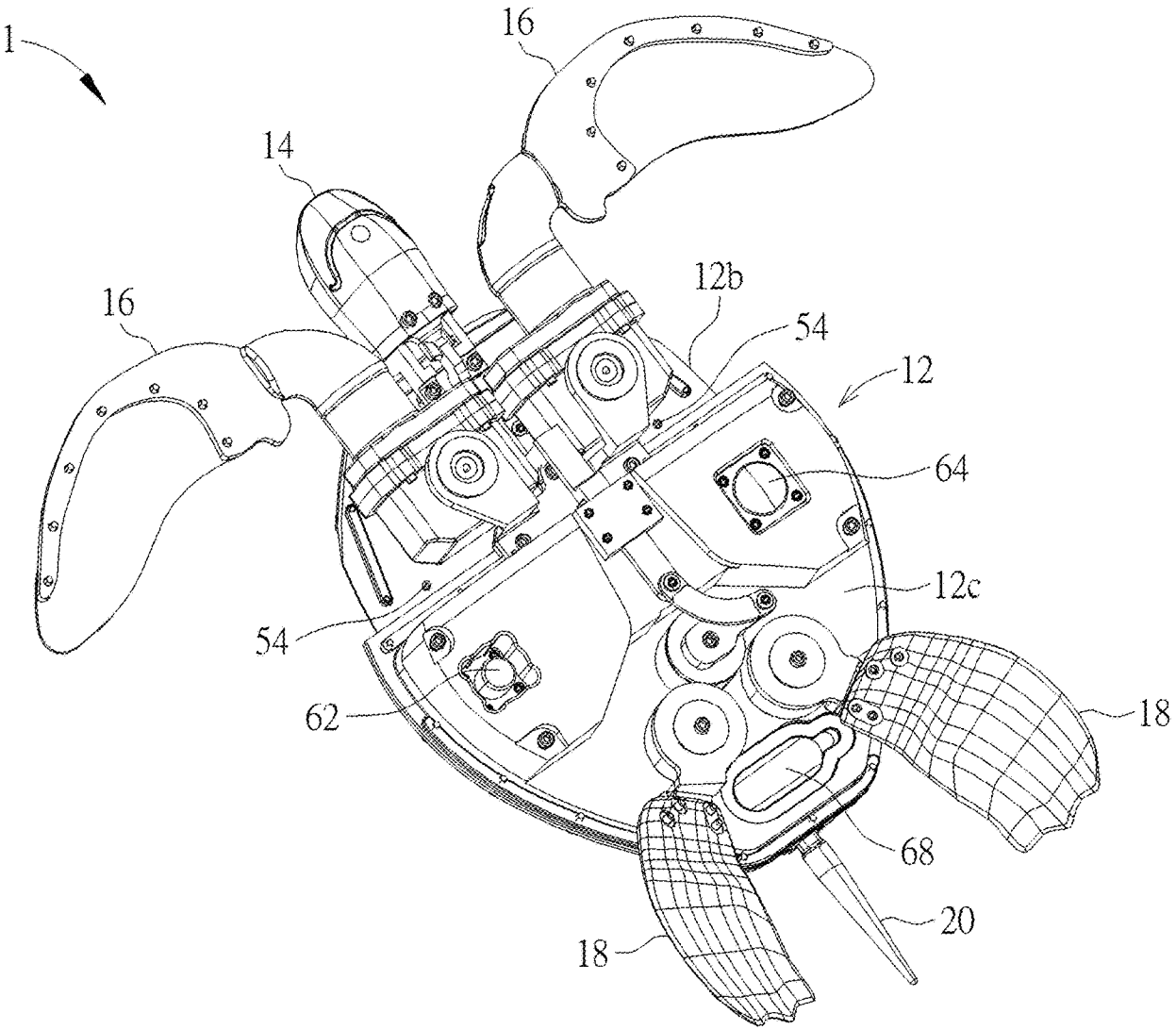
FIG. 4 is a perspective view illustrating the bionic animal shown in FIG. 3 from another viewing angle.
Figure 5:
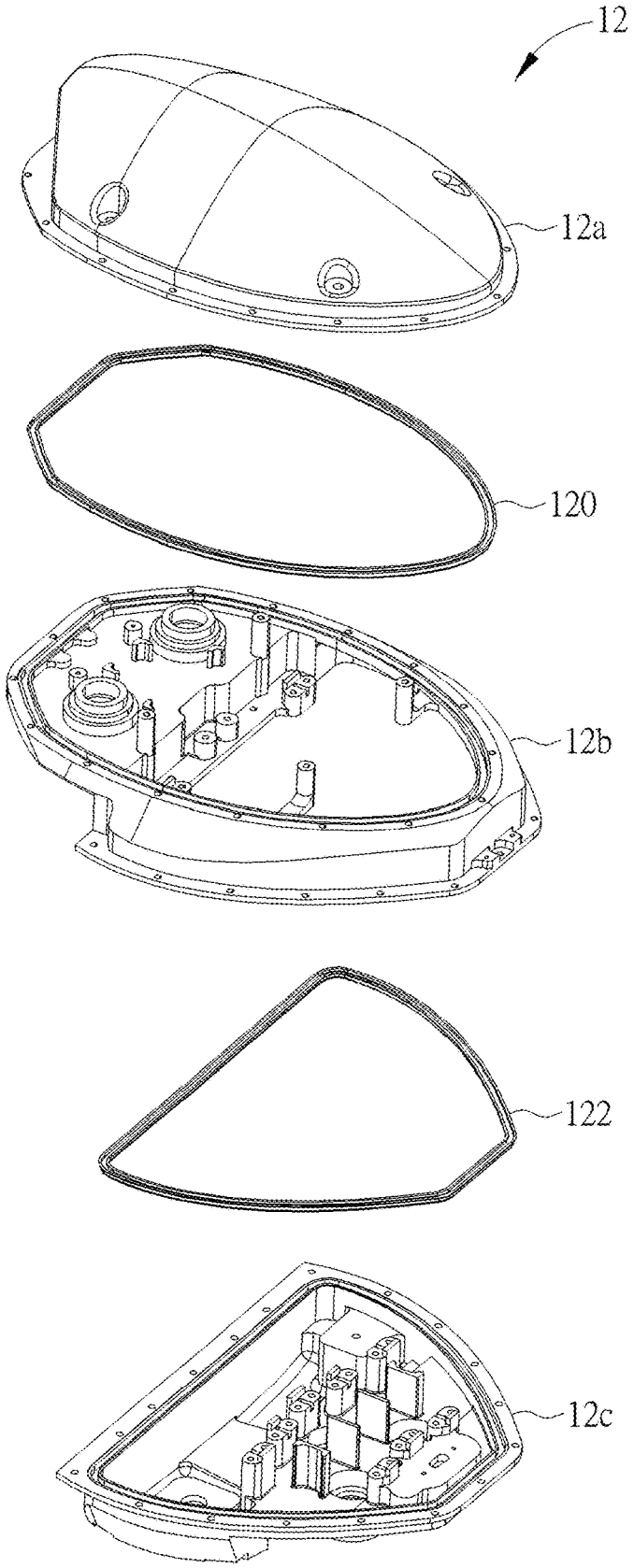
FIG. 5 is an exploded view illustrating a shell shown in FIG. 3.
Figure 6:
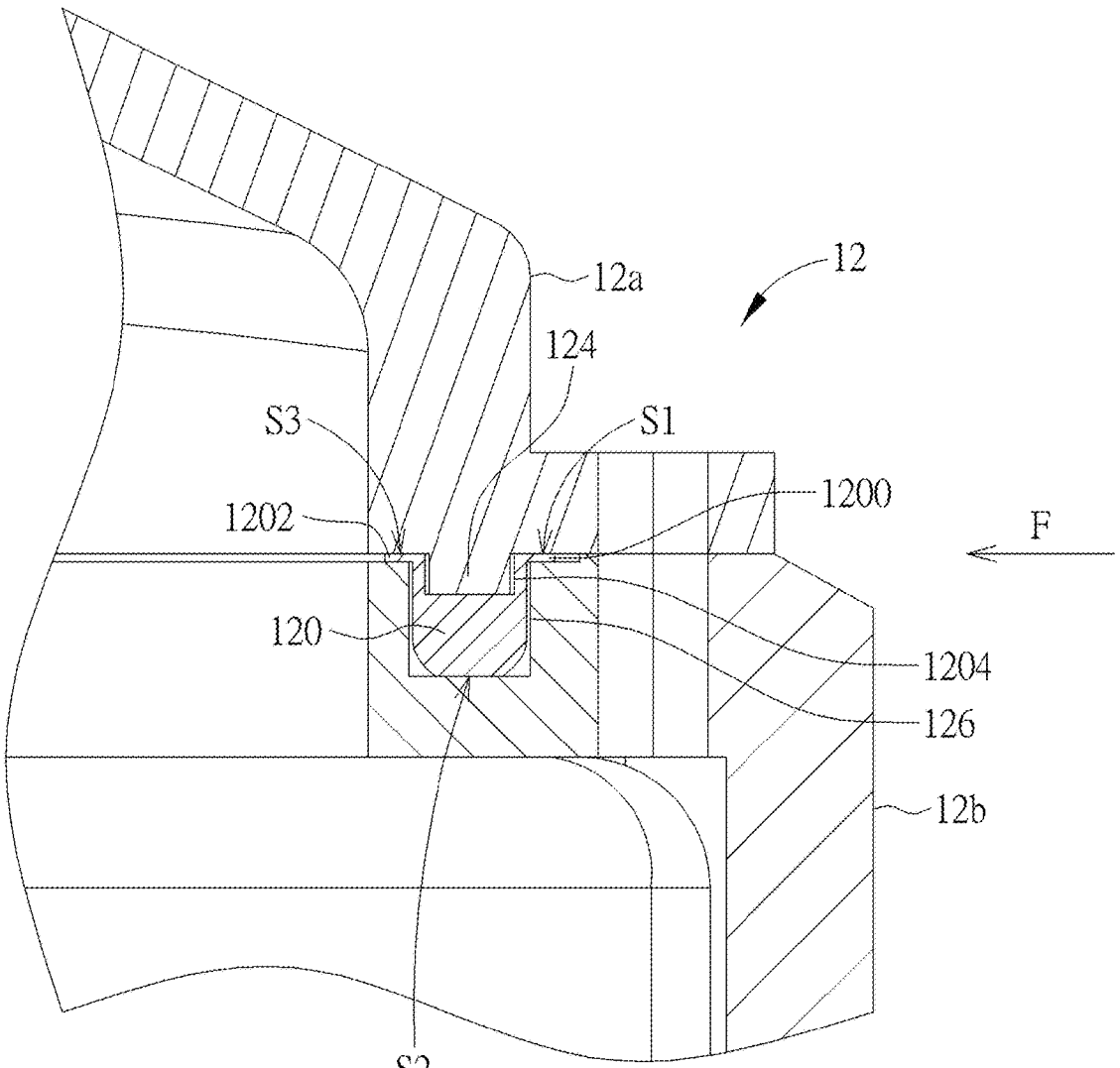
FIG. 6 is a partial sectional view illustrating the shell shown in FIG. 3.
Figure 7:
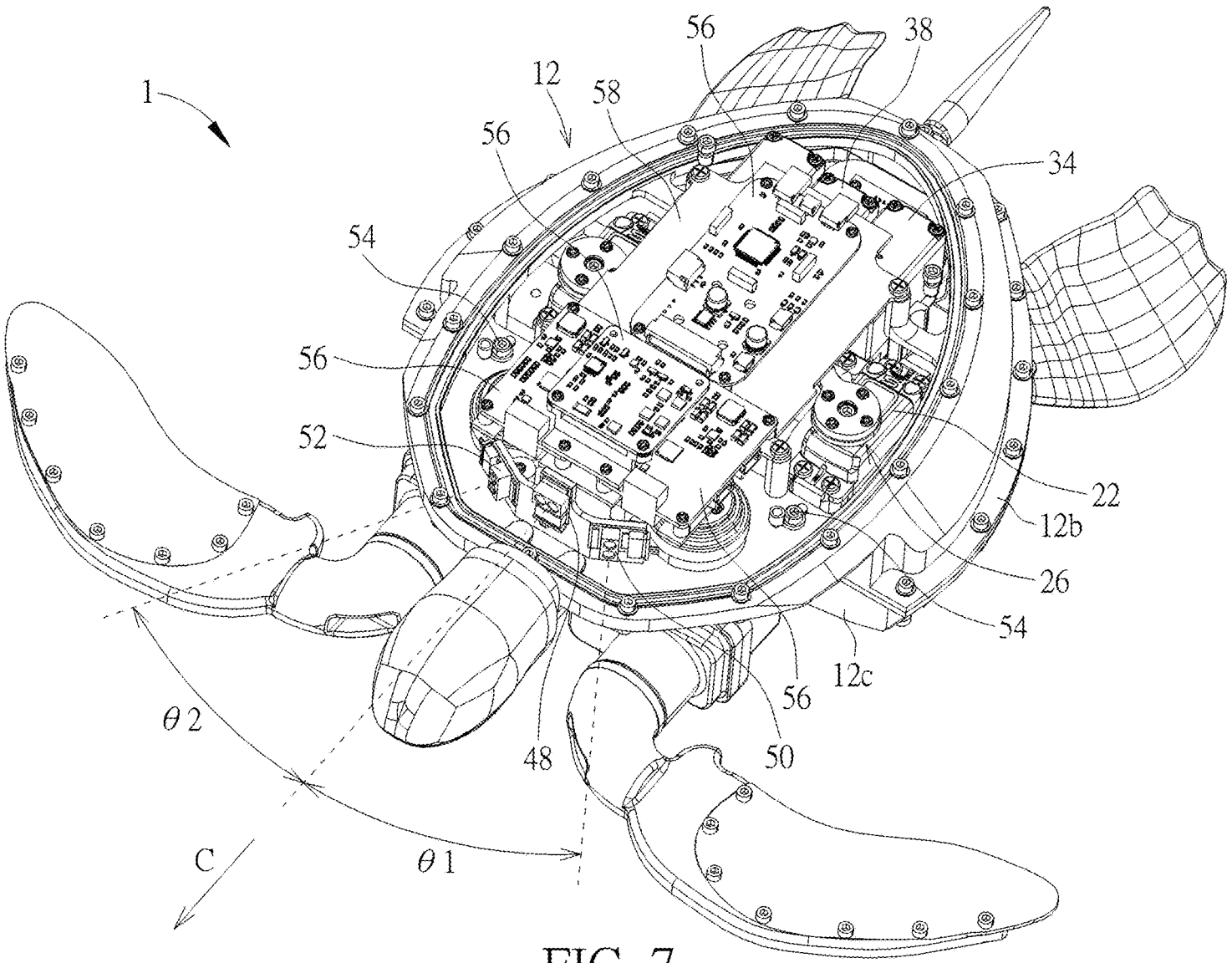
FIG. 7 is a perspective view illustrating the bionic animal shown in FIG. 3 without an upper shell.
Figure 8:
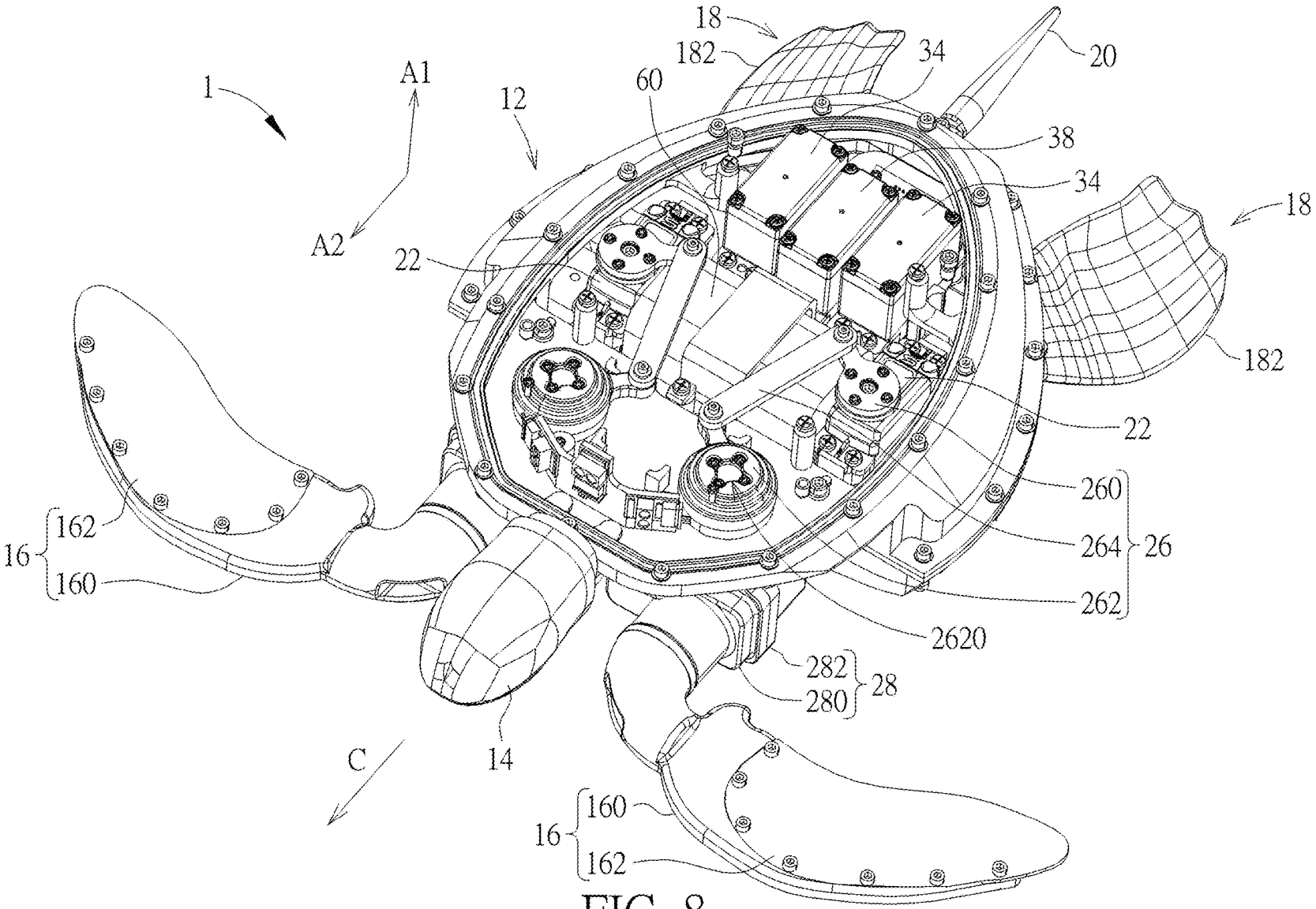
FIG. 8 is a perspective view illustrating the bionic animal shown in FIG. 7 without circuit boards and a partition.
Figure 9:
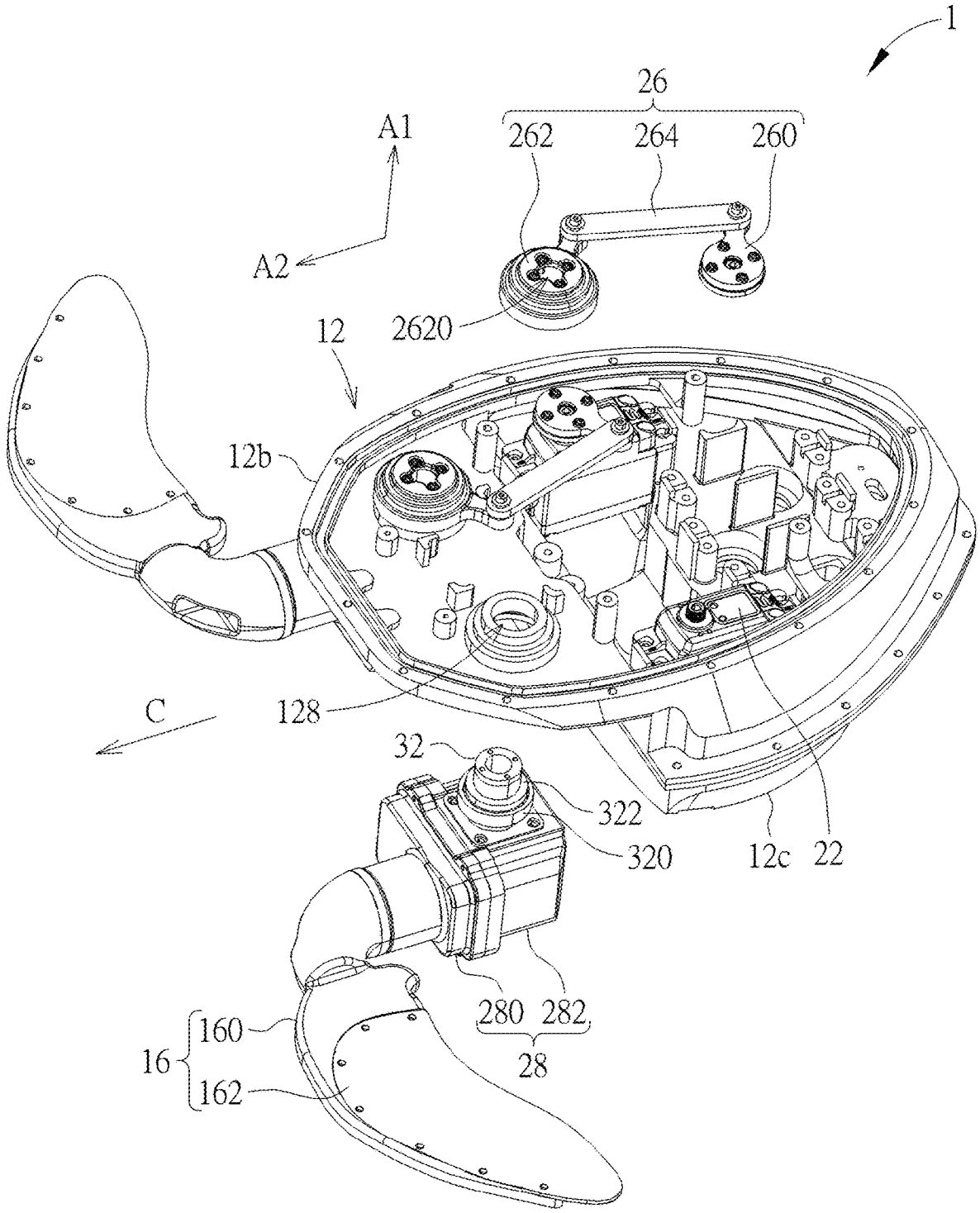
FIG. 9 is a partial exploded view illustrating the bionic animal shown in FIG. 8.
Figure 10:
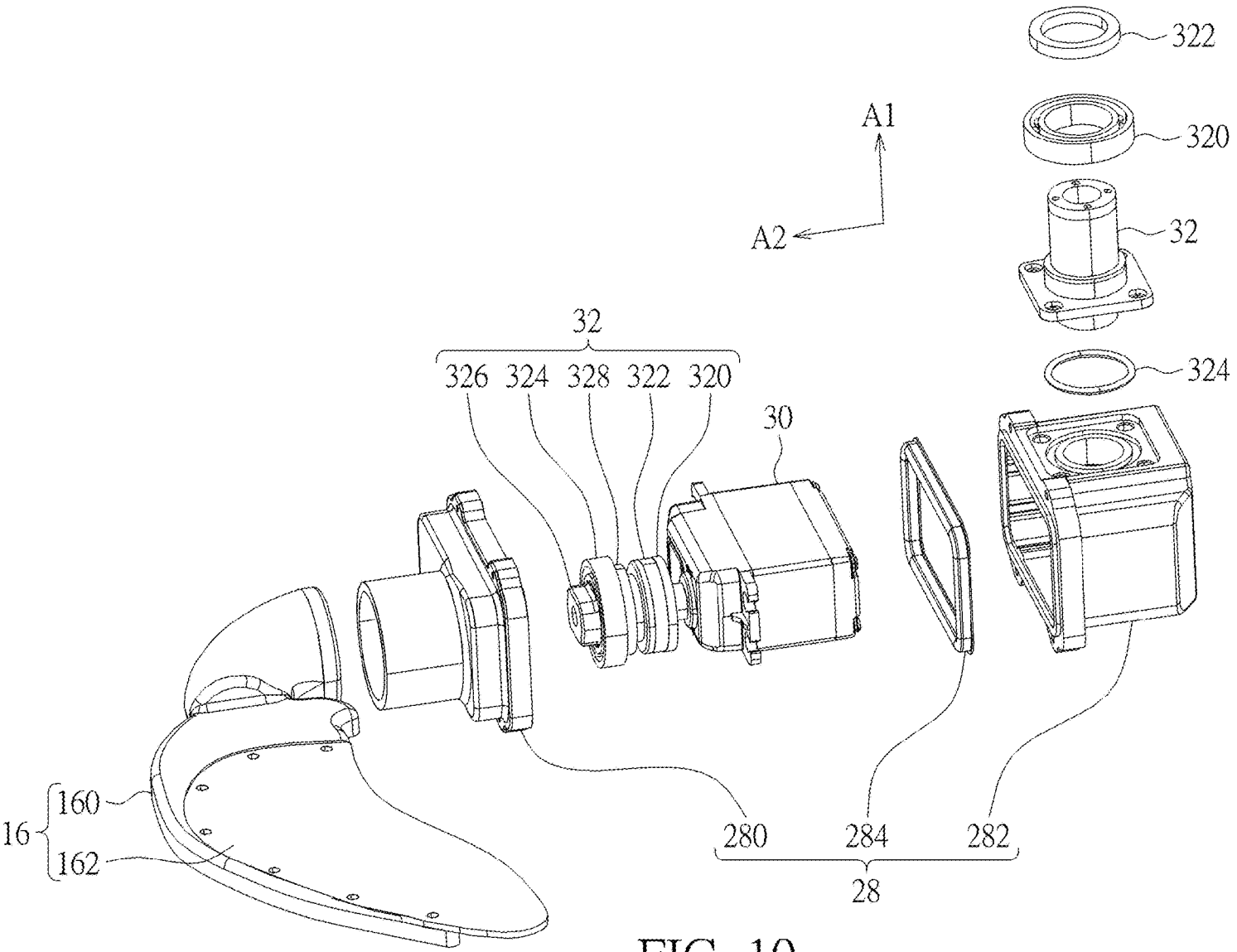
FIG. 10 is an exploded view illustrating a front foot assembly shown in FIG. 9 and related components thereof.
Figure 11:
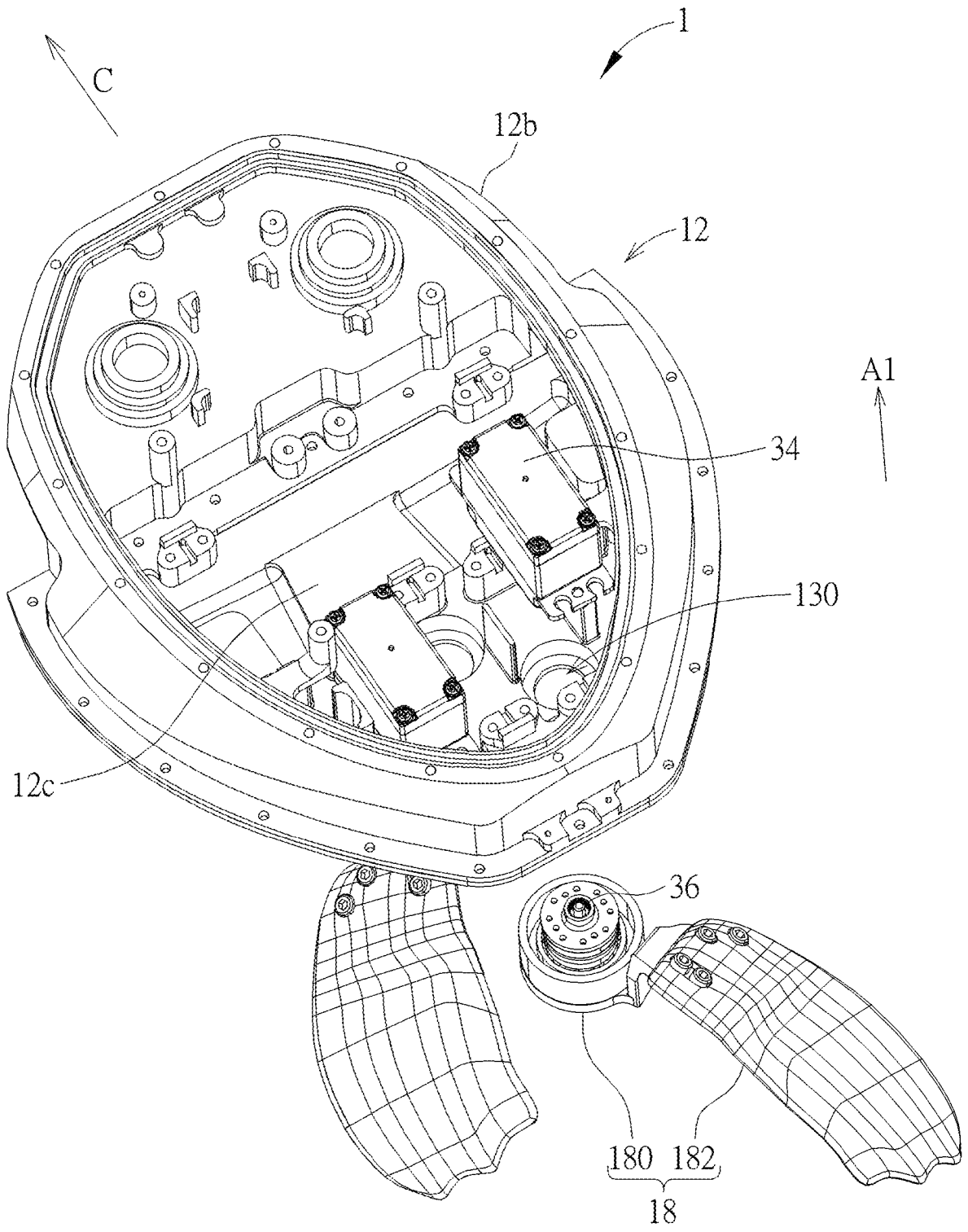
FIG. 11 is another exploded view illustrating the bionic animal shown in FIG. 8.
Figure 12:
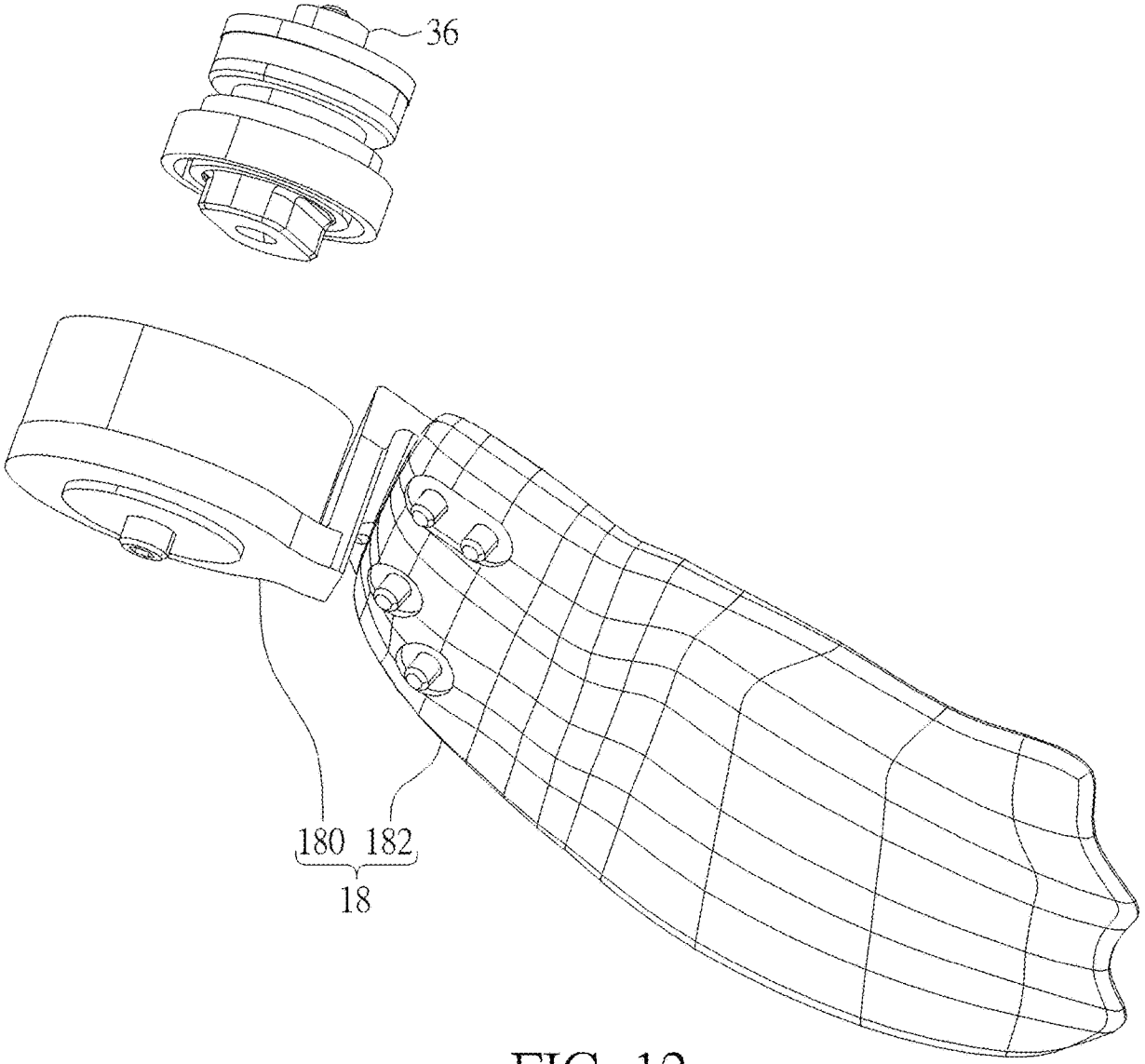
FIG. 12 is an exploded view illustrating a rear foot assembly shown in FIG. 11 and related components thereof.
Figure 13:
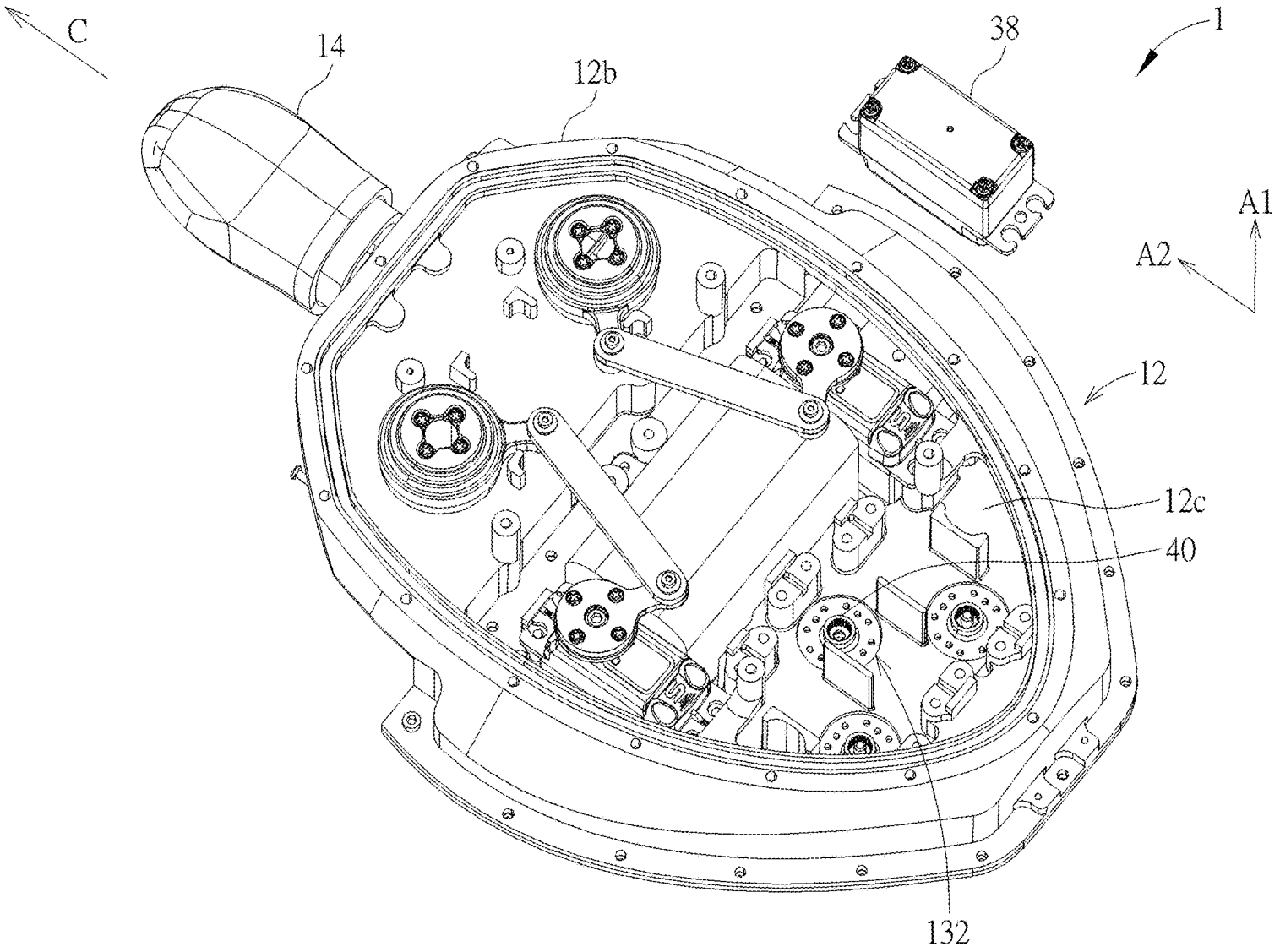
FIG. 13 is another exploded view illustrating the bionic animal shown in FIG. 8.
Figure 14:
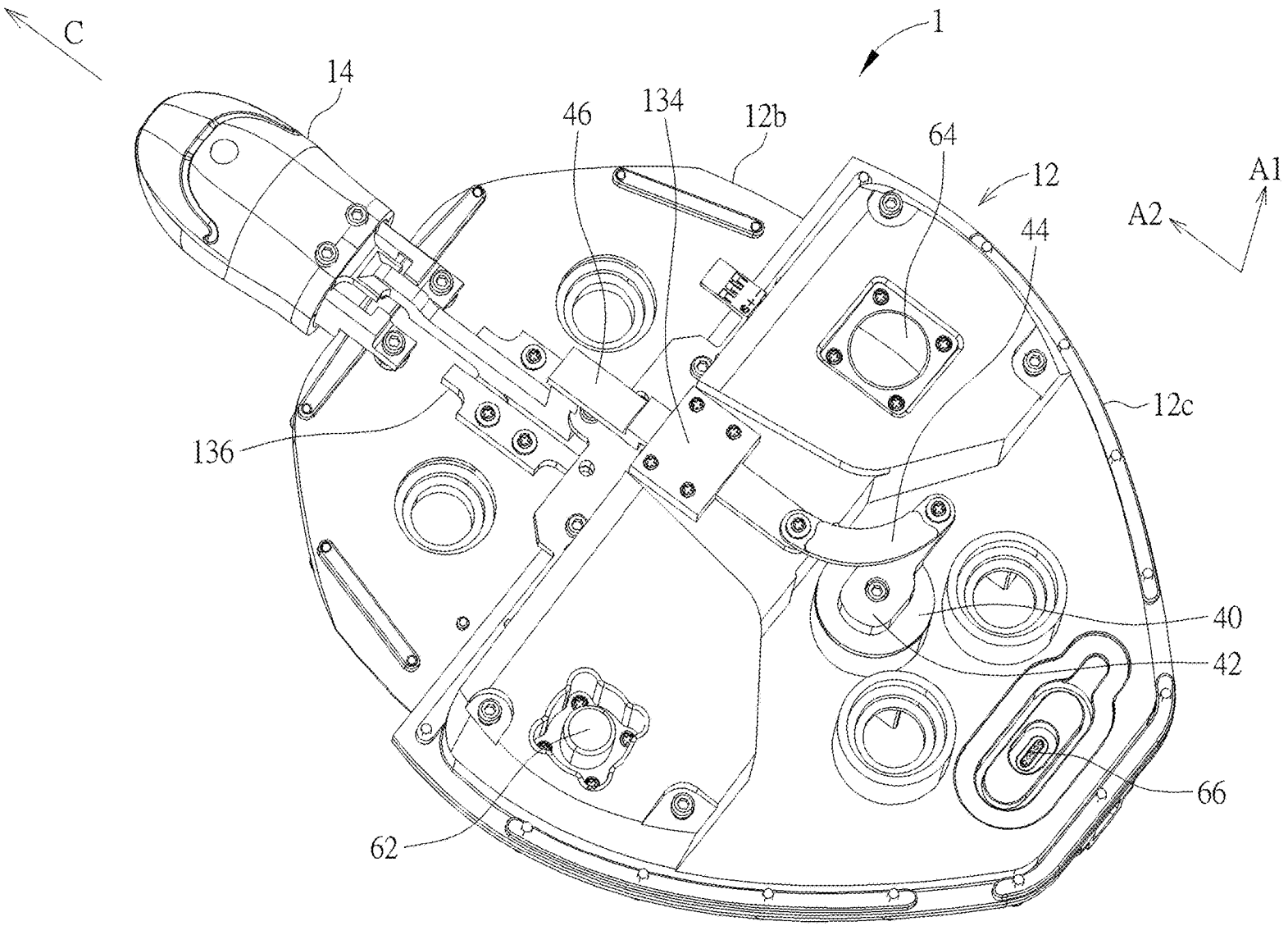
FIG. 14 is a perspective view illustrating the bionic animal shown in FIG. 13 from another viewing angle.

Referring to FIGS. 1 to 14, FIG. 1 is a perspective view illustrating a bionic animal 1 according to an embodiment of the invention, FIG. 2 is a perspective view illustrating the bionic animal 1 shown in FIG. 1 from another viewing angle, FIG. 3 is a perspective view illustrating the bionic animal 1 shown in FIG. 1 without an outer cover 10, FIG. 4 is a perspective view illustrating the bionic animal 1 shown in FIG. 3 from another viewing angle, FIG. 5 is an exploded view illustrating a shell 12 shown in FIG. 3, FIG. 6 is a partial sectional view illustrating the shell 12 shown in FIG. 3, FIG. 7 is a perspective view illustrating the bionic animal 1 shown in FIG. 3 without an upper shell 12*a*, FIG. 8 is a perspective view illustrating the bionic animal 1 shown in FIG. 7 without circuit boards 56 and a partition 58, FIG. 9 is a partial exploded view illustrating the bionic animal 1 shown in FIG. 8, FIG. 10 is an exploded view illustrating a front foot assembly 16 shown in FIG. 9 and related components thereof, FIG. 11 is another exploded view illustrating the bionic animal 1 shown in FIG. 8, FIG. 12 is an exploded view illustrating a rear foot assembly 18 shown in FIG. 11 and related components thereof, FIG. 13 is another exploded view illustrating the bionic animal 1 shown in FIG. 8, and FIG. 14 is a perspective view illustrating the bionic animal 1 shown in FIG. 13 from another viewing angle.

The bionic animal 1 of the invention may be, but is not limited to, a bionic turtle. The type of the bionic animal 1 may be determined according to practical applications. As shown in FIGS. 1 to 4 the bionic animal 1 comprises an outer cover 10, a shell 12, a head 14, a front foot assembly 16, a rear foot assembly 18 and a tail 20. The shell 12 is configured to accommodate the main mechanical components and electronic components of the bionic animal 1. The outer cover 10 is disposed on the outside of the shell 12 for decoration. In this embodiment, the outer cover 10 may be, but is not limited to, a turtle shell. The head 14 extends from a front side of the shell 12 and the tail 20 extends from a rear side of the shell 12. In this embodiment, the bionic animal 1 may comprise two front foot assemblies 16 and two rear foot assemblies 18, wherein the two front foot assemblies 16 are located on two sides of the front side of the shell 12, and the two rear foot assemblies 18 are located on two sides of the rear side of the shell 12.

The front foot assembly 16 may comprise a front foot bracket 160 and a soft front foot member 162, wherein the soft front foot member 162 is fixed to the front foot bracket 160. The rear foot assembly 18 may comprise a rear foot bracket 180 and a soft rear foot member 182, wherein the soft rear foot member 182 is fixed to the rear foot bracket 180. In this embodiment, the soft front foot member 162, the soft rear foot member 182 and the tail 20 may be made of silicone, rubber or other soft materials. Accordingly, the soft front foot member 162, the soft rear foot member 182 and the tail 20 may achieve a swing effect closer to an actual turtle without polluting the water.

In this embodiment, the outer cover 10 may comprise an upper cover 10*a* and a lower cover 10*b*, and the shell 12 may comprise an upper shell 12*a*, a middle shell 12*b* and a lower shell 12*c*. The upper shell 12*a*, the middle shell 12*b* and the lower shell 12*c* are fixed with each other, the upper cover 10*a* may be fixed to the upper shell 12*a*, and the lower cover 10*b* may be fixed to the lower shell 12*c*. As shown in FIG. 5, the shell 12 may further comprise a first sealing ring 120 and a second sealing ring 122. The first sealing ring 120 is sandwiched between the upper shell 12*a* and the middle shell 12*b*, and the second sealing ring 122 is sandwiched between the middle shell 12*b* and the lower shell 12*c*, so as to form a waterproof space in the shell 12.

As shown in FIG. 6, the first sealing ring 120 may have an outer flange 1200, an inner flange 1202 and a first recess 1204, the upper shell 12*a* may have a boss 124, and the middle shell 12*b* may have a second recess 126. The first recess 1204 of the first sealing ring 120 is located between the outer flange 1200 and the inner flange 1202. The boss 124 of the upper shell 12*a* may be configured to position the first sealing ring 120. The first sealing ring 120 is embedded in the second recess 126 of the middle shell 12*b*, the boss 124 of the upper shell 12*a* is embedded in the first recess 1204 of the first sealing ring 120, and the outer flange 1200 and the inner flange 1202 of the first sealing ring 120 are sandwiched between the upper shell 12*a* and the middle shell 12*b*. When the upper shell 12*a* and the middle shell 12*b* are fixed, three pre-pressure surfaces S1, S2, S3 are formed at positions corresponding to the outer flange 1200, the boss 124, and the inner flange 1202. A water flow F outside the shell 12 will first be blocked by the pre-pressure surface S1. When the pre-pressure surface S1 fails, the water flow F will be blocked by the pre-pressure surface S2. When the pre-pressure surface S2 also fails, the water flow F will be blocked by the pre-pressure surface S3. Through the design of three pre-pressure surfaces S1, S2, S3, the shell 12 may achieve a highly reliable waterproof function. It should be noted that the structural design between the middle shell 12*b*, the lower shell 12*c* and the second sealing ring 122 may be identical to the structural design between the upper shell 12*a*, the middle shell 12*b* and the first sealing ring 120, and will not be described again herein.

As shown in FIG. 9, the shell 12 has a first shaft hole 128. In this embodiment, the first shaft hole 128 may be formed on the middle shell 12*b*. Furthermore, as shown in FIGS. 9 and 10, the bionic animal 1 further comprises a first front foot driving motor 22, a first front foot rotating shaft 24, a transmission mechanism 26, a frame 28, a second front foot driving motor 30 and a second front foot rotating shaft 32. The first front foot driving motor 22 is disposed in the shell 12. The first front foot rotating shaft 24 is disposed in the first shaft hole 128. The transmission mechanism 26 is disposed in the shell 12 and connected to the first front foot driving motor 22 and the first front foot rotating shaft 24.

In this embodiment, the first front foot rotating shaft 24 further comprises a first anti-rust bearing 240, a fourth sealing ring 242 and a fifth sealing ring 244. The fourth sealing ring 242 is sandwiched between the shell 12 and the first anti-rust bearing 240, and the fifth sealing ring 244 is sandwiched between the first front foot rotating shaft 24 and the frame 28. Through the arrangement of the first anti-rust bearing 240, the fourth sealing ring 242 and the fifth sealing ring 244, the waterproof function may be achieved. The fourth sealing ring 242 and the fifth sealing ring 244 may be, but are not limited to, O-rings.

In this embodiment, the transmission mechanism 26 may comprise a first crank 260, a swing arm 262 and a first linkage rod 264, wherein the first crank 260 is connected to the first front foot driving motor 22, the swing arm 262 is connected to the first front foot rotating shaft 24, and the first linkage rod 264 is connected to the first crank 260 and the swing arm 262. Accordingly, the first front foot driving motor 22 may drive the first crank 260 to rotate around a first axis A1, and the first crank 260 may drive the swing arm 262 to rotate around the first axis A1 through the first linkage rod 264, so as to drive the first front foot rotating shaft 24 to rotate around the first axis A1.

The frame 28 is connected to the first front foot rotating shaft 24. In this embodiment, the frame 28 may comprise a metal front frame 280, a plastic rear frame 282 and a third sealing ring 284. The plastic rear frame 282 is connected to the first front foot rotating shaft 24. The third sealing ring 284 is sandwiched between the metal front frame 280 and the plastic rear frame 282 to achieve waterproof function. It should be noted that the structural design between the metal front frame 280, the plastic rear frame 282 and the third sealing ring 284 may be identical to the structural design between the upper shell 12*a*, the middle shell 12*b* and the first sealing ring 120, and will not be described again herein. The second front foot driving motor 30 is disposed in the frame 28. The second front foot rotating shaft 32 is disposed in the frame 28 and connected to the second front foot driving motor 30. The front foot assembly 16 is connected to the second front foot rotating shaft 32. In this embodiment, the front foot bracket 160 of the front foot assembly 16 is connected to the second front foot rotating shaft 32.

In this embodiment, the second front foot rotating shaft 32 may comprise a first adapter ring 320, a second adapter ring 322, a second anti-rust bearing 324, a transmission shaft 326 and a sixth sealing ring 328. The first adapter ring 320 is connected to the second front foot driving motor 30. The second adapter ring 322 is connected to the first adapter ring 320. The transmission shaft 3226 is connected to the second adapter ring 322 and the front foot assembly 16. The second anti-rust bearing 324 is sleeved on the transmission shaft 326. The sixth sealing ring 328 is sandwiched between the second anti-rust bearing 324 and the metal front frame 280 of the frame 28. The sixth sealing ring 328 may be, but is not limited to, an O-ring. In this embodiment, the swing arm 262 may be formed with a wiring hole 2620, such that a wire of the second front foot driving motor 30 may be connected to a circuit board in the shell 12 through the first front foot rotating shaft 24 and the wiring hole 2620.

As shown in FIGS. 8 to 10, the first front foot driving motor 22 may drive the frame 28 to rotate around the first axis A1 through the transmission mechanism 26 and the first front foot rotating shaft 24 to drive the front foot assembly 16 to rotate around the first axis A1. Furthermore, the second front foot driving motor 30 may drive the front foot assembly 16 to rotate around a second axis A2 through the second front foot rotating shaft 32. The first axis A1 is perpendicular to the second axis A2. In this embodiment, the first axis A1 may be perpendicular to a body axis C of the bionic animal 1, and the second axis A2 may be parallel to the body axis C of the bionic animal 1, as shown in FIG. 1. In this embodiment, an output shaft of the first front foot driving motor 22 is parallel to the first axis A1, i.e. the output shaft of the first front foot driving motor 22 is perpendicular to the body axis C of the bionic animal 1. Still further, an output shaft of the second front foot driving motor 30 is parallel to the second axis A2, i.e. the output shaft of the second front foot driving motor 30 is parallel to the body axis C of the bionic animal 1. When the front foot assembly 16 rotates around the second axis A2, the front foot assembly 16 may swing up and down to advance in water or support the body on land. When the front foot assembly 16 rotates around the first axis A1, the front foot assembly 16 may swing forward and backward to move forward. Accordingly, the front foot assembly 16 of the bionic animal 1 may swing up, down, forward and backward, thereby giving the bionic animal 1 a variety of movements, such that the bionic animal 1 is able to swim underwater or crawl on land. Furthermore, the center of gravity of the bionic animal 1 may be shifted through the swing of the front foot assembly 16 to achieve control of floating and diving.

As shown in FIG. 11, the shell 12 further has a second shaft hole 130. In this embodiment, the second shaft hole 130 may be formed on the lower shell 12*c*. Furthermore, as shown in FIGS. 11 and 12, the bionic animal 1 further comprises a rear foot driving motor 34 and a rear foot rotating shaft 36. The rear foot driving motor 34 is disposed in the shell 12. In this embodiment, an output shaft of the rear foot driving motor 34 is parallel to the first axis A1, i.e. the output shaft of the rear foot driving motor 34 is perpendicular to the body axis C of the bionic animal 1. The rear foot rotating shaft 36 is disposed in the second shaft hole 130 and connected to the rear foot driving motor 34. The rear foot assembly 18 is connected to the rear foot rotating shaft 36. In this embodiment, the rear foot bracket 180 of the rear foot assembly 18 is connected to the rear foot rotating shaft 36. Accordingly, the rear foot driving motor 34 may drive the rear foot assembly 18 to rotate around the first axis A1 through the rear foot rotating shaft 36. When the rear foot assembly 18 rotates around the first axis A1, the rear foot assembly 18 may swing freely to achieve the function of controlling steering.

As shown in FIG. 13, the shell 12 further has a third shaft hole 132. In this embodiment, the third shaft hole 132 may be formed on the lower shell 12*c*. Furthermore, as shown in FIG. 14, the shell 12 further has a guiding member 134 and a restraining member 136. In this embodiment, the guiding member 134 may be disposed on the lower shell 12*c* and the restraining member 136 may be disposed on the middle shell 12*b*. Still further, as shown in FIGS. 13 and 14, the bionic animal 1 further comprises a head driving motor 38, a head rotating shaft 40, a second crank 42, a second linkage rod 44 and a sliding rod 46. The head driving motor 38 is disposed in the shell 12. In this embodiment, an output shaft of the head driving motor 38 is parallel to the first axis A1, i.e. the output shaft of the head driving motor 38 is perpendicular to the body axis C of the bionic animal 1. The head rotating shaft 40 is disposed in the third shaft hole 132 and connected to the head driving motor 38. The second crank 42 is connected to the head rotating shaft 40. The second linkage rod 44 is connected to the second crank 42. The sliding rod 46 is connected to the second linkage rod 44 and passes through the guiding member 134 and the restraining member 136. The guiding member 134 and the restraining member 136 are configured to restrain a moving direction of the sliding rod 46. The head 14 is connected to the sliding rod 46. Accordingly, the head driving motor 38 may drive the second crank 42 to rotate around the first axis A1 through the head rotating shaft 40, and the second crank 42 may drive the head 14 to move along the second axis A2 through the second linkage rod 44 and the sliding rod 46, i.e. the head 14 may move forward and backward along the body axis C of the bionic animal 1. At the same time, the center of gravity of the bionic animal 1 may be shifted through the movement of the head 14 to achieve control of floating and diving.

As shown in FIG. 7, the bionic animal 1 may further comprise a first infrared sensor 48, a second infrared sensor 50 and a third infrared sensor 52. The first infrared sensor 48, the second infrared sensor 50 and the third infrared sensor 52 are disposed in the shell 12 and located behind the head 14. The first infrared sensor 48 is located between the second infrared sensor 50 and the third infrared sensor 52. The first infrared sensor 48, the second infrared sensor 50 and the third infrared sensor 52 may be respectively configured to detect obstacles in front, left and right of the bionic animal 1. By disposing the first infrared sensor 48, the second infrared sensor 50 and the third infrared sensor 52 behind the head 14, the bionic animal 1 may have enough time to make avoidance actions in advance when it encounters an obstacle. In this embodiment, an orientation of the first infrared sensor 48 may be parallel to the body axis C of the bionic animal 1, an angle θ1 between the orientation of the first infrared sensor 48 and an orientation of the second infrared sensor 50 may be larger than 0 degrees and smaller than or equal to 90 degrees, and an angle θ2 between the orientation of the first infrared sensor 48 and an orientation of the third infrared sensor 52 may be larger than 0 degrees and smaller than or equal to 90 degrees. The angle θ1, θ2 may be determined according to the practical required detection range.

As shown in FIGS. 4 and 7, the bionic animal 1 may further comprise two electrodes 54 exposed from the shell 12. In this embodiment, the two electrodes 54 may be disposed on the middle shell 12*b* and exposed from a lower surface of the middle shell 12*b*. The two electrodes 54 are configured to sense a voltage difference to determine whether the bionic animal 1 is in water or on land. In practical applications, a controller (not shown) of the bionic animal 1 may determine whether the bionic animal 1 is in water or on land by the voltage difference sensed by the two electrodes 54, so as to control the first front foot driving motor 22, the second front foot driving motor 30, the rear foot driving motor 34 and the head driving motor 38 to drive the front foot assembly 16, the rear foot assembly 18 and the head 14 to perform corresponding actions.

As shown in FIG. 7, the bionic animal 1 may further comprise at least one circuit board 56 and a partition 58. The at least one circuit board 56 and the partition 58 are disposed in the shell 12. The first front foot driving motor 22, the rear foot driving motor 34, the head driving motor 38 and the transmission mechanism 26 are located at a side of the partition 58, and the at least one circuit board 56 is located at another side of the partition 58. In other words, the invention may utilize the partition 58 to separate a mechanism space and a circuit space, such that the mechanism will not interfere or rub with the wires in the circuit space and cause damage as the mechanism is moving. In this embodiment, the bionic animal 1 may comprise four circuit boards 56, but the invention is not so limited.

As shown in FIG. 8, the bionic animal 1 may further comprise a battery module 60. In this embodiment, the bionic animal 1 comprises two first front foot driving motors 22, two transmission mechanisms 26 and two rear foot driving motors 34 for respectively driving two front foot assemblies 16 and two rear foot assemblies 18. The two first front foot driving motors 22, the two rear foot driving motors 34, the head driving motor 38 and the battery module 60 are disposed in the shell 12. In this embodiment, the first front foot driving motor 22 is closer to the head 14 than the rear foot driving motor 34. The two first front foot driving motors 22, the two rear foot driving motors 34 and the head driving motor 38 are located around the battery module 60. In other words, an accommodating space is formed between the two first front foot driving motors 22, the two rear foot driving motors 34 and the head driving motor 38 to accommodate the battery module 60. Furthermore, two first linkage rods 264 of the two transmission mechanisms 26 are located between the two first front foot driving motors 22. Accordingly, the size of the bionic animal 1 may be effectively reduced.

As shown in FIG. 4, the bionic animal 1 may further comprise an airtight test hole 62 disposed on the bottom of the shell 12. Before entering water, it is convenient for the bionic animal 1 to perform an airtight test to confirm that there is no air leakage. Furthermore, as shown in FIGS. 4 and 14, the bionic animal 1 may further comprise a power switch 64, an electrical connector 66 and a waterproof cover 68. The power switch 64 and the electrical connector 66 are also disposed on the bottom of the shell 12. The waterproof cover 68 covers the electrical connector 66 to prevent the electrical connector 66 from being damaged by water.

As mentioned in the above, the first front foot driving motor may drive the front foot assembly to rotate around the first axis through the transmission mechanism and the first front foot rotating shaft, and the second front foot driving motor may drive the front foot assembly to rotate around the second axis through the second front foot rotating shaft. Accordingly, the front foot assembly of the bionic animal may swing up, down, forward and backward, thereby giving the bionic animal a variety of movements, such that the bionic animal is able to swim underwater or crawl on land. Furthermore, the rear foot driving motor may drive the rear foot assembly to rotate around the first axis through the rear foot rotating shaft, such that the rear foot assembly is able to swing freely. Moreover, the head driving motor may drive the head to move along the second axis through the head rotating shaft, the second crank, the second linkage rod and the sliding rod. The center of gravity of the bionic animal may be shifted through the swing of the front foot assembly and/or the movement of the head to achieve control of floating and diving. The invention may achieve waterproof requirements through the arrangement of multiple sealing rings. In an embodiment, three infrared sensors located behind the head may be configured to detect obstacles in front, left and right of the bionic animal. In an embodiment, the invention may utilize the two electrodes exposed from the shell to sense the voltage difference to determine whether the bionic animal is in water or on land.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bionic animal comprising:

a shell having a first shaft hole;

a first front foot driving motor disposed in the shell;

a first front foot rotating shaft disposed in the first shaft hole;

a transmission mechanism disposed in the shell and connected to the first front foot driving motor and the first front foot rotating shaft;

a frame connected to the first front foot rotating shaft;

a second front foot driving motor disposed in the frame;

a second front foot rotating shaft disposed in the frame and connected to the second front foot driving motor; and a front foot assembly connected to the second front foot rotating shaft;

wherein the first front foot driving motor drives the frame to rotate around a first axis through the transmission mechanism and the first front foot rotating shaft to drive the front foot assembly to rotate around the first axis; the second front foot driving motor drives the front foot assembly to rotate around a second axis through the second front foot rotating shaft; and the first axis is perpendicular to the second axis.

2. The bionic animal of claim 1, wherein the shell comprises an upper shell, a middle shell, a lower shell, a first sealing ring and a second sealing ring, the first sealing ring is sandwiched between the upper shell and the middle shell, and the second sealing ring is sandwiched between the middle shell and the lower shell.

3. The bionic animal of claim 2, wherein the first sealing ring has an outer flange, an inner flange and a first recess, the first recess is located between the outer flange and the inner flange, the upper shell has a boss, the middle shell has a second recess, the first sealing ring is embedded in the second recess, the boss is embedded in the first recess, and the outer flange and the inner flange are sandwiched between the upper shell and the middle shell.

4. The bionic animal of claim 1, wherein the transmission mechanism comprises a first crank, a swing arm and a first linkage rod, the first crank is connected to the first front foot driving motor, the swing arm is connected to the first front foot rotating shaft, and the first linkage rod is connected to the first crank and the swing arm.

5. The bionic animal of claim 4, wherein the swing arm is formed with a wiring hole.

6. The bionic animal of claim 1, wherein the frame comprises a metal front frame, a plastic rear frame and a third sealing ring, the plastic rear frame is connected to the first front foot rotating shaft, and the third sealing ring is sandwiched between the metal front frame and the plastic rear frame.

7. The bionic animal of claim 1, wherein the first front foot rotating shaft further comprises a first anti-rust bearing, a fourth sealing ring and a fifth sealing ring, the fourth sealing ring is sandwiched between the shell and the first anti-rust bearing, and the fifth sealing ring is sandwiched between the first front foot rotating shaft and the frame.

8. The bionic animal of claim 1, wherein the second front foot rotating shaft comprises a first adapter ring, a second adapter ring, a second anti-rust bearing and a transmission shaft, the first adapter ring is connected to the second front foot driving motor, the second adapter ring is connected to the first adapter ring, the transmission shaft is connected to the second adapter ring and the front foot assembly, and the second anti-rust bearing is sleeved on the transmission shaft.

9. The bionic animal of claim 1, wherein the front foot assembly comprises a front foot bracket and a soft front foot member, the front foot bracket is connected to the second front foot rotating shaft, and the soft front foot member is fixed to the front foot bracket.

10. The bionic animal of claim 1, wherein the shell further has a second shaft hole, the bionic animal further comprises:

a rear foot driving motor disposed in the shell;

a rear foot rotating shaft disposed in the second shaft hole and connected to the rear foot driving motor; and a rear foot assembly connected to the rear foot rotating shaft;

wherein the rear foot driving motor drives the rear foot assembly to rotate around the first axis through the rear foot rotating shaft.

11. The bionic animal of claim 10, wherein the rear foot assembly comprises a rear foot bracket and a soft rear foot member, the rear foot bracket is connected to the rear foot rotating shaft, and the soft rear foot member is fixed to the rear foot bracket.

12. The bionic animal of claim 1, wherein the shell further has a third shaft hole, a guiding member and a restraining member, the bionic animal further comprises:

a head driving motor disposed in the shell;

a head rotating shaft disposed in the third shaft hole and connected to the head driving motor;

a second crank connected to the head rotating shaft;

a second linkage rod connected to the second crank;

a sliding rod connected to the second linkage rod and passing through the guiding member and the restraining member, the guiding member and the restraining member restraining a moving direction of the sliding rod; and a head connected to the sliding rod;

wherein the head driving motor drives the second crank to rotate around the first axis through the head rotating shaft, and the second crank drives the head to move along the second axis through the second linkage rod and the sliding rod.

13. The bionic animal of claim 1, further comprising a head, a first infrared sensor, a second infrared sensor and a third infrared sensor, wherein the head extends from a front side of the shell, the first infrared sensor, the second infrared sensor and the third infrared sensor are disposed in the shell and located behind the head, and the first infrared sensor is located between the second infrared sensor and the third infrared sensor.

14. The bionic animal of claim 13, wherein an angle between an orientation of the first infrared sensor and an orientation of the second infrared sensor is larger than 0 degrees and smaller than or equal to 90 degrees, and an angle between the orientation of the first infrared sensor and an orientation of the third infrared sensor is larger than 0 degrees and smaller than or equal to 90 degrees.

15. The bionic animal of claim 1, further comprising two electrodes exposed from the shell, wherein the two electrodes are configured to sense a voltage difference to determine whether the bionic animal is in water or on land.

16. The bionic animal of claim 1, further comprising at least one circuit board and a partition, wherein the at least one circuit board and the partition are disposed in the shell, the first front foot driving motor and the transmission mechanism are located at a side of the partition, and the at least one circuit board is located at another side of the partition.

17. The bionic animal of claim 1, further comprising a rear foot driving motor, a head driving motor and a battery module, wherein the rear foot driving motor, the head driving motor and the battery module are disposed in the shell, and the first front foot driving motor, the rear foot driving motor and the head driving motor are located around the battery module.

18. The bionic animal of claim 1, further comprising a head and a rear foot driving motor, wherein the head extends from a front side of the shell, the rear foot driving motor is disposed in the shell, and the first front foot driving motor is closer to the head than the rear foot driving motor.

* * * * *